US006784770B2

(12) United States Patent
Gimenez et al.

(10) Patent No.: US 6,784,770 B2
(45) Date of Patent: Aug. 31, 2004

(54) EARTH LEAKAGE DETECTION DEVICE

(75) Inventors: Miguel Ortiz Gimenez, Terrassa (ES); Pere Planas Comerma, Terrassa (ES)

(73) Assignee: General Electric Company, Schenectady, NY (US)

( * ) Notice: Subject to any disclaimer, the term of this patent is extended or adjusted under 35 U.S.C. 154(b) by 401 days.

(21) Appl. No.: 09/732,651

(22) Filed: Dec. 6, 2000

(65) Prior Publication Data

US 2001/0022713 A1 Sep. 20, 2001

(30) Foreign Application Priority Data

Mar. 17, 2000 (ES) ..... 200000655

(51) Int. Cl.[7] ..... H01H 75/00
(52) U.S. Cl. ..... 335/18; 335/202; 335/132
(58) Field of Search ..... 335/132, 202, 335/18; 361/42–51

(56) References Cited

U.S. PATENT DOCUMENTS 4,578,732 A 3/1986 Draper et al.
4,688,134 A 8/1987 Freeman et al.
5,541,800 A 7/1996 Misencik
5,933,063 A 8/1999 Keung et al.
6,262,871 B1 * 7/2001 Nemir et al. ..... 361/42
6,392,513 B1 * 5/2002 Whipple et al. ..... 335/18

* cited by examiner

*Primary Examiner*—Lincoln Donovan
(74) *Attorney, Agent, or Firm*—Cantor Colburn LLP

(57) ABSTRACT

An earth leakage detection device (14) includes a housing (52) and an earth leakage detection circuit (114) mounted within said housing (52) for detecting earth leakage in the electrical distribution circuit. A dielectric test switch (115) is arranged between the electrically conductive strap (18) and the earth leakage detection circuit (114). Pressing the button (84) causes said dielectric test switch (115) to stop the flow of electrical current from said electrically conductive strap (18) to said earth leakage detection circuit (114) to protect the circuit (114) during dielectric testing. A lever arm (605), pivotally secured within said housing (52), causes said trip/reset mechanism (116) to actuate the circuit breaker (12) when said button (84) is pressed. The trip/reset mechanism (116) is resiliently mounted within said housing (52), independently from said transformer (182). An auxiliary switch driver (224) is attached to an auxiliary switch carrier (225) for positioning a plunger (222) of an auxiliary switch (112) mounted to the housing of the trip/reset mechanism (116). An electronic component and transformer mounting structure (118), along with a transformer mounting cover (148) form an electrically insulative barrier between said toroidal assembly (284) and said plurality of electrically conductive pass-through straps (286).

8 Claims, 12 Drawing Sheets

EARTH LEAKAGE DETECTION DEVICE

BACKGROUND OF THE INVENTION

The present invention relates generally to earth leakage (ground fault) detection devices. More specifically, the present invention relates to earth leakage detection devices for use with molded case circuit breakers.

An earth leakage detection device is generally installed in an electrical power distribution circuit in conjunction with a molded case circuit breaker. The earth leakage detection device detects the existence of certain predefined earth leakage current levels. If such current levels exist, the earth leakage detection device causes the circuit breaker to trip, thus stopping current flow to the protected circuit. Together, the earth leakage detection device and the molded case circuit breaker provide overcurrent and earth leakage protection to the distribution circuit.

A conventional earth leakage detection device generally comprises a housing in which different mechanical, electrical and electronic elements are enclosed. This housing can be separate from, or integral to, the housing for the associated molded case circuit breaker. Within the housing, the earth leakage detection device includes a plurality of conductive straps, one strap being provided for each pole of the electrical distribution circuit. Each of these straps passes through a torous-shaped, ferrous core mounted within the housing. Typically, the toroidal core and the straps are wrapped in insulative tape. The straps passing through the toroidal core form the primary winding of a current transformer. A secondary winding of the current transformer is electrically connected to earth leakage detection electronics mounted within the housing.

Typically, the principle applied to determine the existence of earth leakage consists of measuring the sum of the electric currents flowing simultaneously in the straps (i.e. each pole of the distribution circuit). When the distribution circuit down-line of the earth leakage detection device functions normally, the sum of the electric current that flows simultaneously though the straps is essentially equal to zero. If there is earth leakage down-line, the sum of the electric currents that flow simultaneously through the straps will no longer be equal to zero and an electric current will be induced in the secondary winding of the transformer. The current induced in the secondary winding is sensed by the earth leakage detection circuitry, which determines the level of current leakage to earth. If detected current level is greater than a predetermined current threshold setting, the earth leakage detection circuitry will provide a trip signal to an electromechanical trip/reset mechanism located within the earth leakage detection device housing. In response to the trip signal, the trip/reset mechanism will trip an operating mechanism within the molded case circuit breaker to stop current flow in the protected circuit. Typically, the predetermined current threshold level and the predetermined trip time can be adjusted using sensitivity adjustment knobs, which extend through the top of the housing of the earth leakage detection device. Current threshold level and maximum trip times are predefined by standards (e.g., Appendix B of IEC 947-2).

In earth leakage detection devices of the prior art, the trip/reset mechanism is rigidly mounted to the support structure for the current transformer. Unfortunately, this arrangement makes the trip/reset mechanism susceptible to the vibration of the current transformer. If the vibration caused by the current transformer (or any other source) is sufficient, the trip/reset mechanism could trip spuriously.

Dielectric testing is performed on the differential circuit breaker to insure adequacy of its insulation. Dielectric testing requires that the technician impart a higher than normal voltage across both the earth leakage detection device and the molded case circuit breaker. Unfortunately, this increased voltage can harm the electronics in the earth leakage detection device. To avoid this damage, the technician must remove the earth leakage detection device from the line before performing this test. However, the removal of the earth leakage detection device is a time consuming process that increases maintenance costs and subjects the earth leakage detection components to damage while they are removed.

BRIEF SUMMARY OF THE INVENTION

In an exemplary embodiment, an earth leakage detection device detects earth leakage in an electrical distribution circuit and actuates a circuit breaker when earth leakage is detected. The earth leakage detection device includes a housing and an earth leakage detection circuit mounted within the housing for detecting earth leakage in the electrical distribution circuit. An electrically conductive strap is arranged to conduct electrical current to the electrical distribution circuit. The electrically conductive strap provides operating current to the earth leakage detection circuit. A dielectric test switch is arranged between said electrically conductive strap and the earth leakage detection circuit. The dielectric test switch includes a button disposed in the housing. When the button is pressed, the dielectric test switch stops the flow of electrical current from the electrically conductive strap to the earth leakage detection circuit to protect the earth leakage detection circuit during dielectric testing. In addition, when the button is pressed, the circuit breaker is actuated.

BRIEF DESCRIPTION OF THE DRAWINGS

The present invention will now be described, by way of example only, with reference to the accompanying drawing in which.

DETAILED DESCRIPTION OF THE INVENTION

Figure 1:
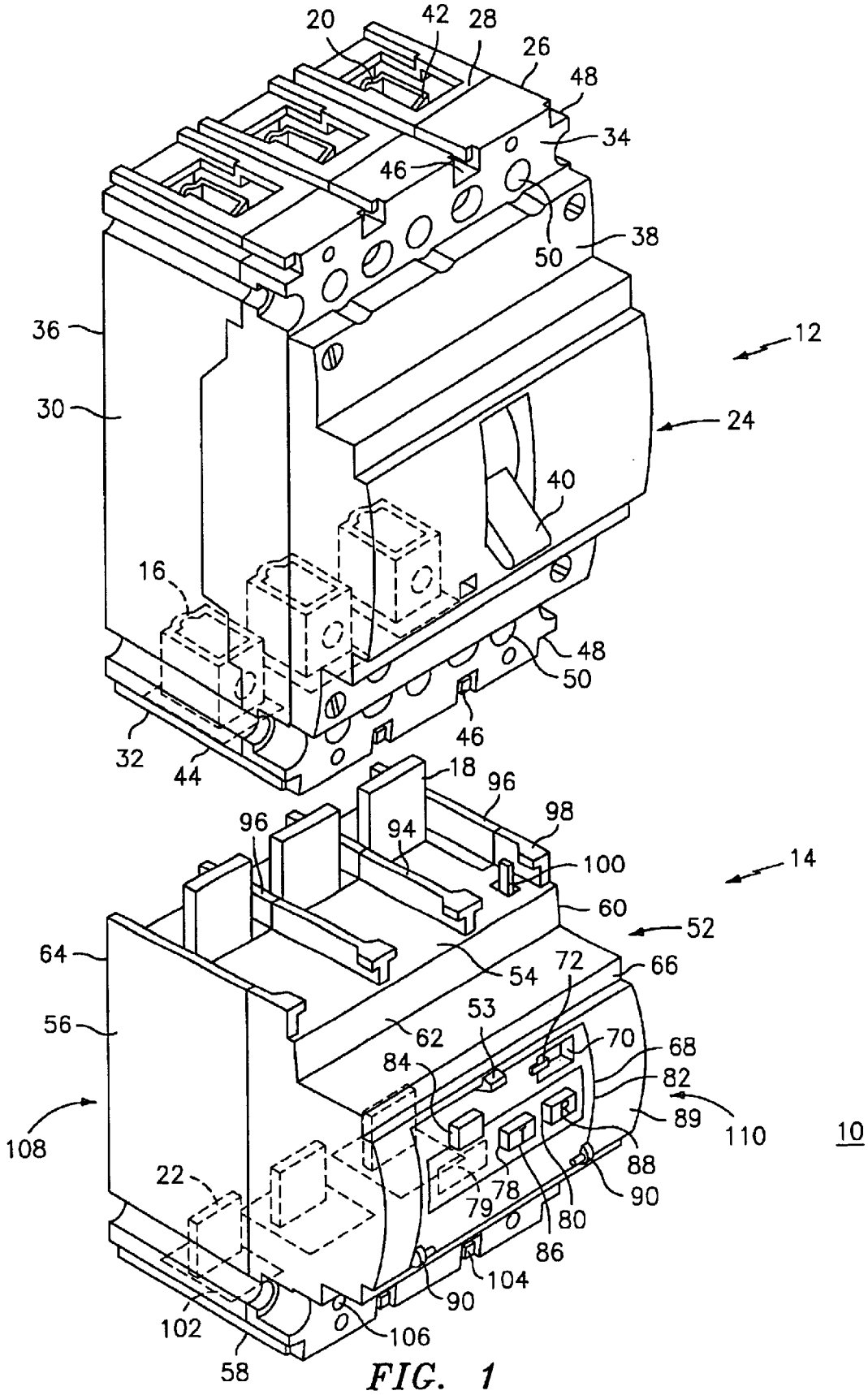
FIG. 1 is a perspective view of a differential circuit breaker of the present invention with earth leakage detection device and molded case circuit breaker separated.

Referring to FIG. 1, a differential circuit breaker is generally shown at 10. Differential circuit breaker 10 comprises a molded case circuit breaker 12 arranged for electrical connection to an earth leakage detection device 14 via load lugs 16 and line straps 18. Differential circuit breaker 10 can be electrically connected to an electrical distribution circuit (not shown), via load straps 22 and line lugs 20, for providing overcurrent and ground fault protection to the distribution circuit.

Molded case circuit breaker (MCCB) 12 includes a housing 24 shaped as a rectangular parallelepiped with four sides 26, 28, 30 and 32, a top 34, and a bottom 36. Top 34 has a raised portion 38 disposed midway between sides 28 and 32. Extending from raised portion 38 is a reset lever 40, which manually opens and closes a set of electrical contacts (not shown) within housing 24. Sides 28 and 32 have a plurality of rectangular openings 42 and 44 formed near bottom 36 for allowing line wiring (not shown) from the protected circuit to be connected to line lugs 20 within housing 24, and line straps 18 to connect with load lugs 16 within housing 24. Sides 28 and 32 of breaker housing 24 also include a plurality of T-shaped slots 46 formed intermediate openings 42, 44 and extending from top 34 to bottom 36. Sides 28 and 32 further included a pair L-shaped slots 48 formed on side corners. A plurality of access holes 50 disposed in top 34 near sides 28 and 32 allow access to line and load side lugs 16, 20. The operation of molded case circuit breaker 12 is well known in the art.

Earth leakage detection device 14 includes a housing 52 having a base 108 and a cover 110. Housing 52 is shaped as a rectangular parallelepiped with four sides 54, 56, 58, and 60 a top 62, and a bottom 64. Cover 110 has a raised portion 66 disposed midway between sides 54 and 58. Raised portion 66 includes a tamper-proof cover 68 hingedly secured within a rectangular recess 82 formed in the raised portion 66 between sides 56 and 60. Raised portion 66 also includes an auxiliary switch (contact block) cover 89 hingedly attached thereto, between the tamper-proof cover 68 and side 60. Auxiliary switch cover 89 provides access for the insertion and removal of an auxiliary switch (not shown) which is mounted within earth leakage detection device 14.

Disposed in tamper-proof cover 68 are apertures 78, and 80. Apertures 78, and 80 accept trip and reset buttons 86 and 88, respectively. Hinges 90 hingedly secure tamper-proof cover 68 to raised portion 66. A latch 53 extends from tamper-proof cover 68 to secure tamper-proof cover 68 in the closed position shown. A recess 70 formed in tamper-proof cover 68 includes a slot disposed therein for accepting a seal tab 72. Seal tab 72 includes an aperture (not shown) disposed therethrough for accepting the hasp of a lock (not shown), such as a wire lock, to prevent seal tab 72 from passing through the slot n recess 70, thereby locking the tamper-proof cover 68 in the closed position. Recess 70 accepts the lock (e.g. the sealed portion of the wire) so that it does not protrude above the tamper-proof cover 68. Tamper-proof cover 68 extends above an edge of auxiliary switch cover 89, thereby preventing auxiliary switch cover 89 from being opened when tamper-proof cover 68 is closed. In a preferred embodiment, tamper-proof cover 68 is constructed of clear plastic, allowing a technician to view components beneath the cover, such as a dielectric test button 84, sensitivity adjustment knobs (shown as 91 in FIG. 2), a trip indicator (shown as 76 in FIG. 2), a mechanical trip test button (shown as 76 in FIG. 2) and a descriptive label 79.

Line straps 18 extend through openings 94 formed in side 54. Located on side 54 intermediate openings 94 are ridges 96, which extend from top 62 to bottom 64. A length of each ridge 96 proximate top 62 includes a flange 98 extending perpendicular thereto. An actuation plunger 100 extends from side 54 between two ridges 96. Actuation plunger 100 extends within an aperture (not shown) in circuit breaker 12 to interact with a circuit breaker operating mechanism (not shown).

Side 58 of earth leakage detection device 14 has a plurality of rectangular openings 102 formed near bottom 64, allowing wiring from the protected circuit (not shown) to be connected to load straps 22 within housing 52. Side 58 also has a plurality of T-shaped slots 104 intermediate openings 102 and extending from top 62 to bottom 64. A plurality of access holes 106 disposed in top 62 near side 58 allows access to load straps 22.

Figure 2:
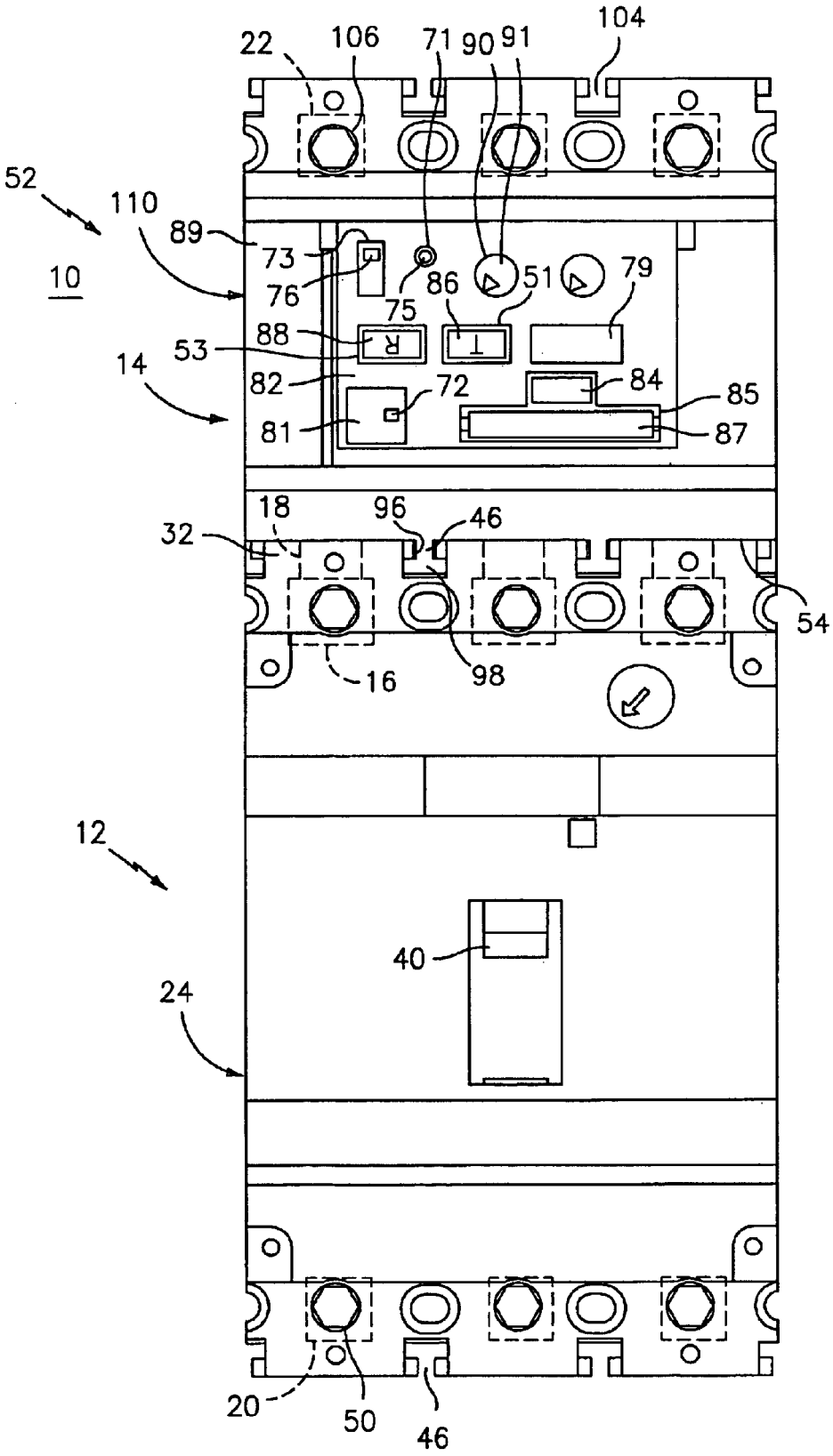
FIG. 2 is a plan view of the differential circuit breaker of FIG. 1 with earth leakage detection device and molded case circuit breaker joined.

Referring to FIG. 2, a plan view of assembled differential circuit breaker 10 of FIG. 1 is shown with tamper-proof cover 68 removed. Line straps 18 extend from earth leakage detection device 14 into load lugs 16 within MCCB 12 to form an electrical connection between line straps 18 and load lugs 16. T-shaped slots 46 formed in side 32 of MCCB 12 receive ridges 96 and flanges 98 on side 54 of earth leakage detection device 14. Flanges 98, ridges 96, and slots 46 mechanically secure the earth leakage detection device 14 to the MCCB 12 in dovetail fashion.

Tamper-proof cover 68 (FIG. 1) of housing 52 has been removed, revealing the rectangular recess 82 formed in cover 110. Trip and reset buttons 86, 88 extend through apertures 51 and 53 in the bottom of rectangular recess 82. Dielectric test button 84 extends through an aperture 85 in rectangular recess 82. Also disposed in aperture 85 is a dielectric test cartridge 87, which will be described in further detail hereinafter. The bottom of rectangular recess 82 includes apertures 90, 71, and 73 with sensitivity adjustment knobs 91, a mechanical trip test button 75, and a trip indicator 76 disposed therethrough. Mechanical trip test button 75 allows manual actuation of the trip mechanism disposed beneath cover 110, as will be described in further detail hereinafter. Trip indicator 76 moves within aperture 73 to provide visual indication that the earth leakage detection device 14 has tripped. The bottom of rectangular recess 82 also includes descriptive label 79 disposed thereon and a recess 81 formed therein. Descriptive label 79 may include such information as setting values for the earth leakage detection device 14. Recess 81 includes seal tab 72 extending from a bottom thereof.

As can be seen by comparison of FIGS. 1 and 2, when tamper-proof cover 68 is closed, the dielectric test cartridge 87, dielectric test button 84, mechanical trip/test button 75, and sensitivity knobs 91 cannot be tampered with. In addition, when tamper-proof cover 68 is closed, the bottom of recess 70 (formed on tamper-proof cover 68) extends within recess 81, and seal tab 72 extends through the slot in recess 70, allowing the tamper-proof cover 68 to be locked in the manner described hereinabove.

Figure 3:
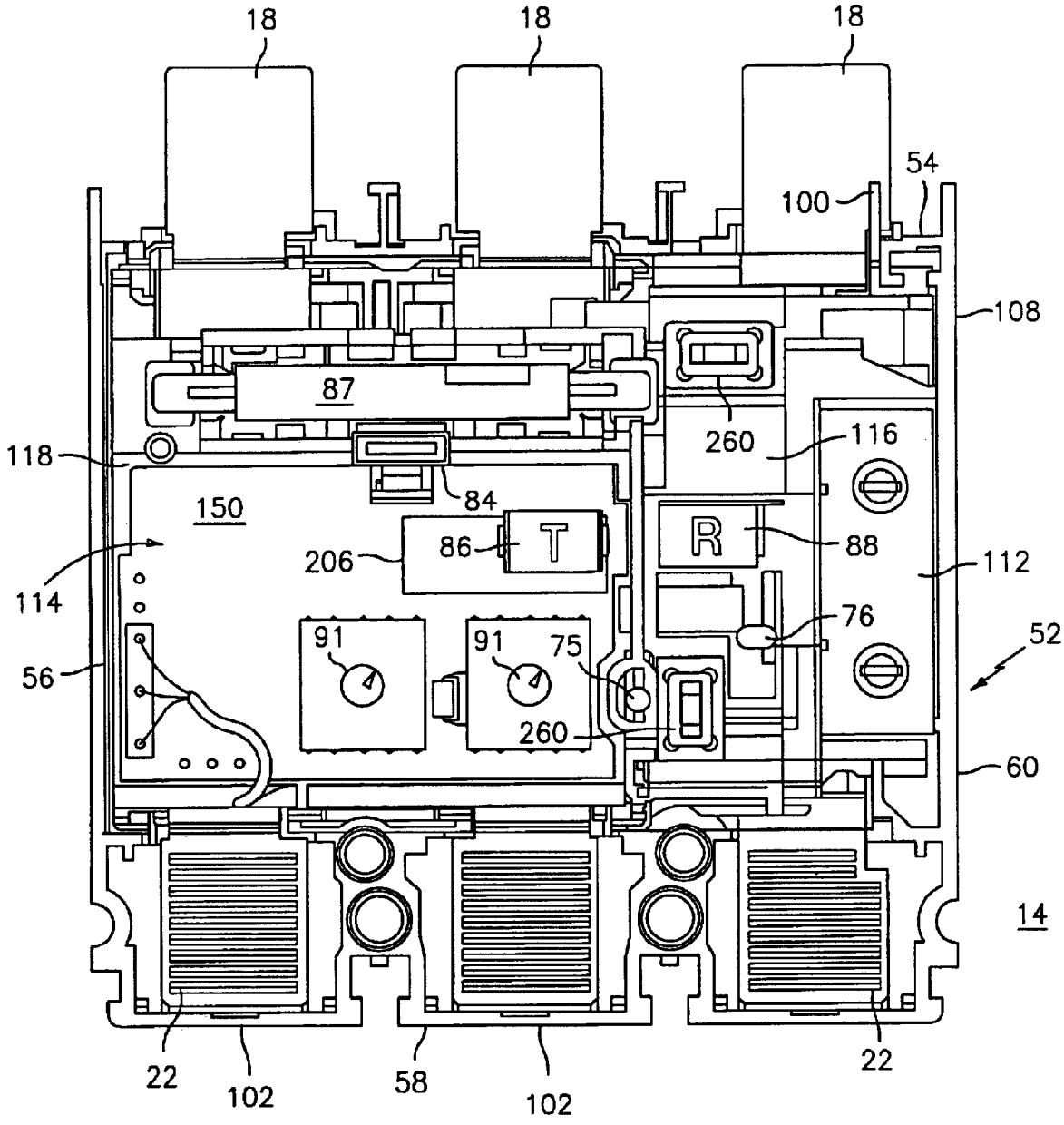
FIG. 3 is a top view of the earth leakage detection device of FIG. 1 with its cover removed.

FIG. 3 shows a plan view of earth leakage detection device 14 with cover 110 (FIGS. 1 and 2) removed. As shown in FIG. 3, earth leakage detection device 14 includes an auxiliary switch 112, earth leakage detection circuitry 114, a trip/reset mechanism 116, an electronic component and transformer mounting structure 118, and line and load straps 18, 22 mounted within base 108.

Trip button 86 is mounted above a micro switch 206 which is mounted on a control circuit board 150. Earth leakage detection circuitry 114 includes control circuit board 150 and a supply circuit board (not shown), which is mounted below control circuit board 150. When trip button 86 is depressed, it contacts micro switch 206, causing the earth leakage detection circuitry 114 to initiate a test of the earth leakage detection components, as will be described in further detail hereinafter. A successful test (or the detection of earth leakage) will result in the actuation of trip/reset mechanism 116 by the earth leakage detection circuitry 114. When activated, trip/reset mechanism 116 causes actuation plunger 100 to move, which activates the operating mechanism (not shown) of circuit breaker 12 (FIGS. 1 and 2) to trip circuit breaker 12 and stop the flow of electrical current to the associated electrical load. Activation of trip/reset mechanism 116 also activates auxiliary switch 112. Auxiliary switch 112 can be used, for example, to provide remote indication of a trip event.

Figure 4:
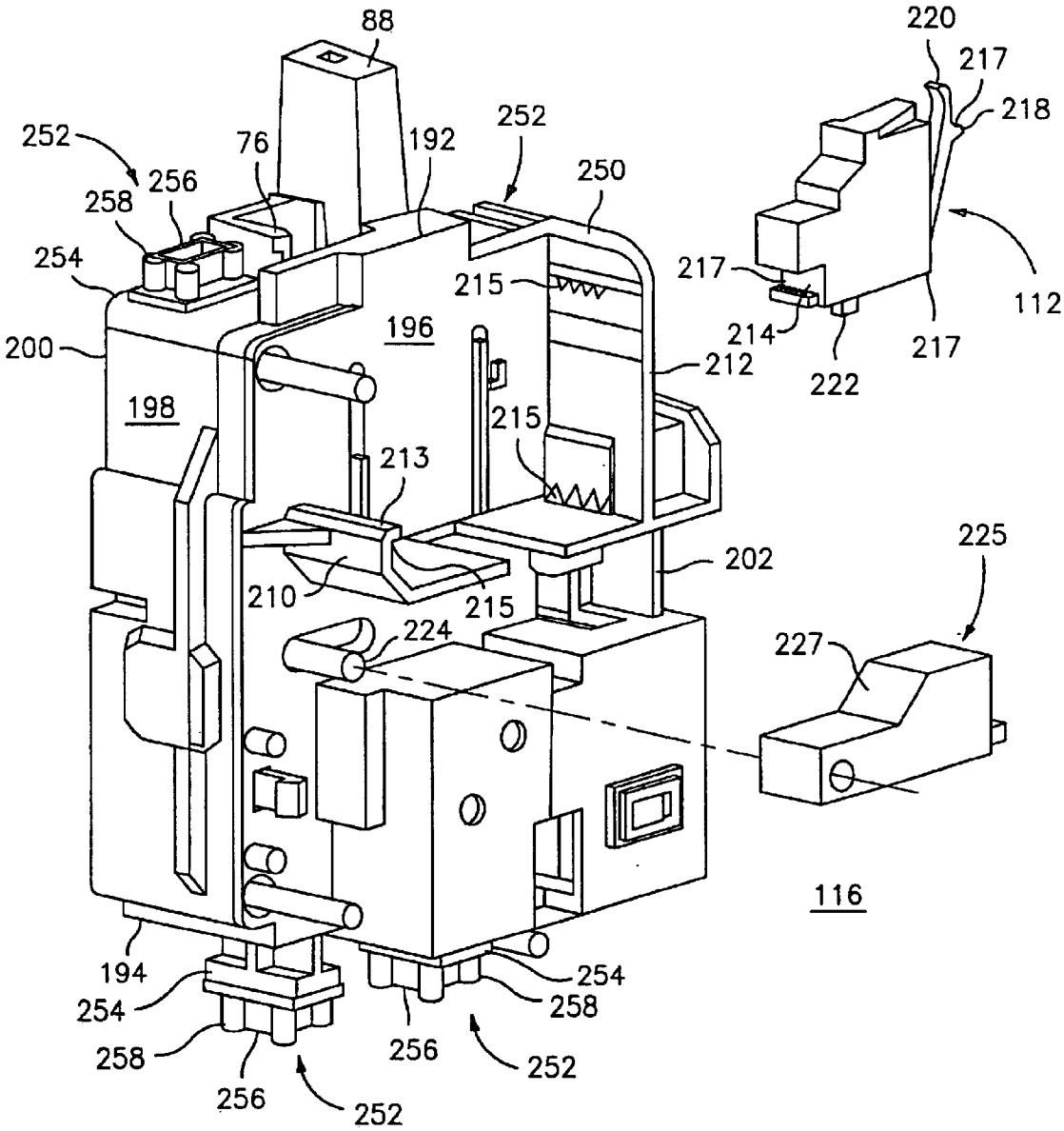
FIG. 4 is a perspective view of the trip/reset mechanism of the earth leakage detection device of FIG. 3.

Referring to FIG. 4, a perspective view of trip/reset mechanism 116 is shown. Trip/reset mechanism 116 includes a housing having a top 192, bottom 194, and sides 196, 198, 200 and 202. Extending from top 192 is the reset button 88. Trip/reset mechanism 116 includes walls 210 and 212 that extend outward from side 196. Wall 210 has an edge 213 for engaging a notch 214 formed in auxiliary switch 112. Wall 212 has an edge 250 for receiving a detent 218 on a spring arm 220 extending from switch 112. Switch 112 is installed by placing notch 214 on edge 213 then forcing switch downward until detent 218 is engaged by edge 250. Spring arm 220, which acts with a force away from switch 112, forces detent 218 beneath edge 250, thereby securing switch 112 in place. Walls 210 and 212 extend beneath a portion of auxiliary switch 112 to provide support to the lower portion of auxiliary switch 112. In a preferred embodiment, edge 213 and wall 212 include teeth 215 disposed thereon. Teeth 215 are arranged to mesh with a plurality of teeth 217 formed on switch 112 to prevent switch 112 from sliding away from trip/reset mechanism 116 when auxiliary switch 112 is installed.

Trip/reset mechanism 116 includes an auxiliary switch driver 224 extending from a slot formed in side 196 of trip/reset mechanism 116. Switch driver 224 is arranged to receive an auxiliary switch carrier 225. When installed, auxiliary switch carrier 225 is positioned beneath auxiliary switch 112 such that a plunger 222 extending from the bottom of switch 112 is positioned above an angular surface 227 formed on the top of auxiliary switch carrier 225. Upon a trip event, auxiliary switch driver 224 moves in the direction of the slot formed in side 196, causing the auxiliary switch carrier 225 to slide in the same direction. The sliding movement of the auxiliary switch carrier 225 causes movement of the plunger 222, which rides along angular surface 227. Movement of the plunger 222 activates the auxiliary switch 112. The internal construction of the trip/reset mechanism 116 will be described, in pertinent part, hereinafter.

The top 192 and bottom 194 of trip reset mechanism each has a pair of support members 252 extending outward therefrom. Each support member 252 is formed to include a flat, rectangular base portion 254 extending substantially parallel to top 192 and bottom 194. A tab 256 with rectangular cross-section extends from the center of each base 254. Fitted around each tab 256 is a vibration dampening device 258.

Figure 5:
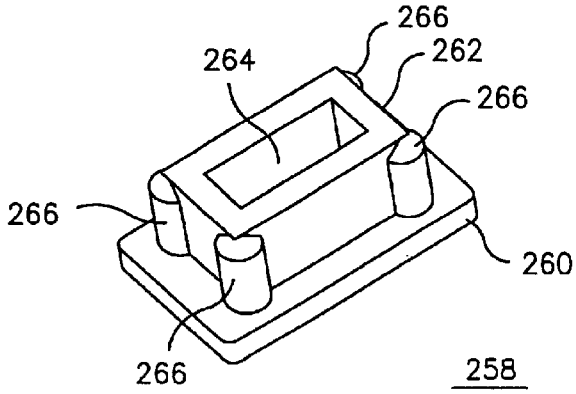
FIG. 5 is a perspective view of the vibration dampening device of FIG. 4.

Referring to FIG. 5, a perspective view of vibration dampening device 258 of FIG. 4 is shown. Vibration dampening device 258 includes a flat, rectangular-shaped base 260 with a parallelepiped-shaped body 262 extending therefrom. A bore 264 of rectangular cross section extends through body 262 and base 260. External corners of body 262 include radiused protrusions 266 extending therefrom. Preferably, base 260, body 262, and radiused protrusions 266 are molded together using an elastomeric material. Referring to FIGS. 4 and 5, vibration dampening device 258 is installed onto support members 252 by press-fitting tab 256 into bore 264 until base 260 contacts base 254.

Figure 6:
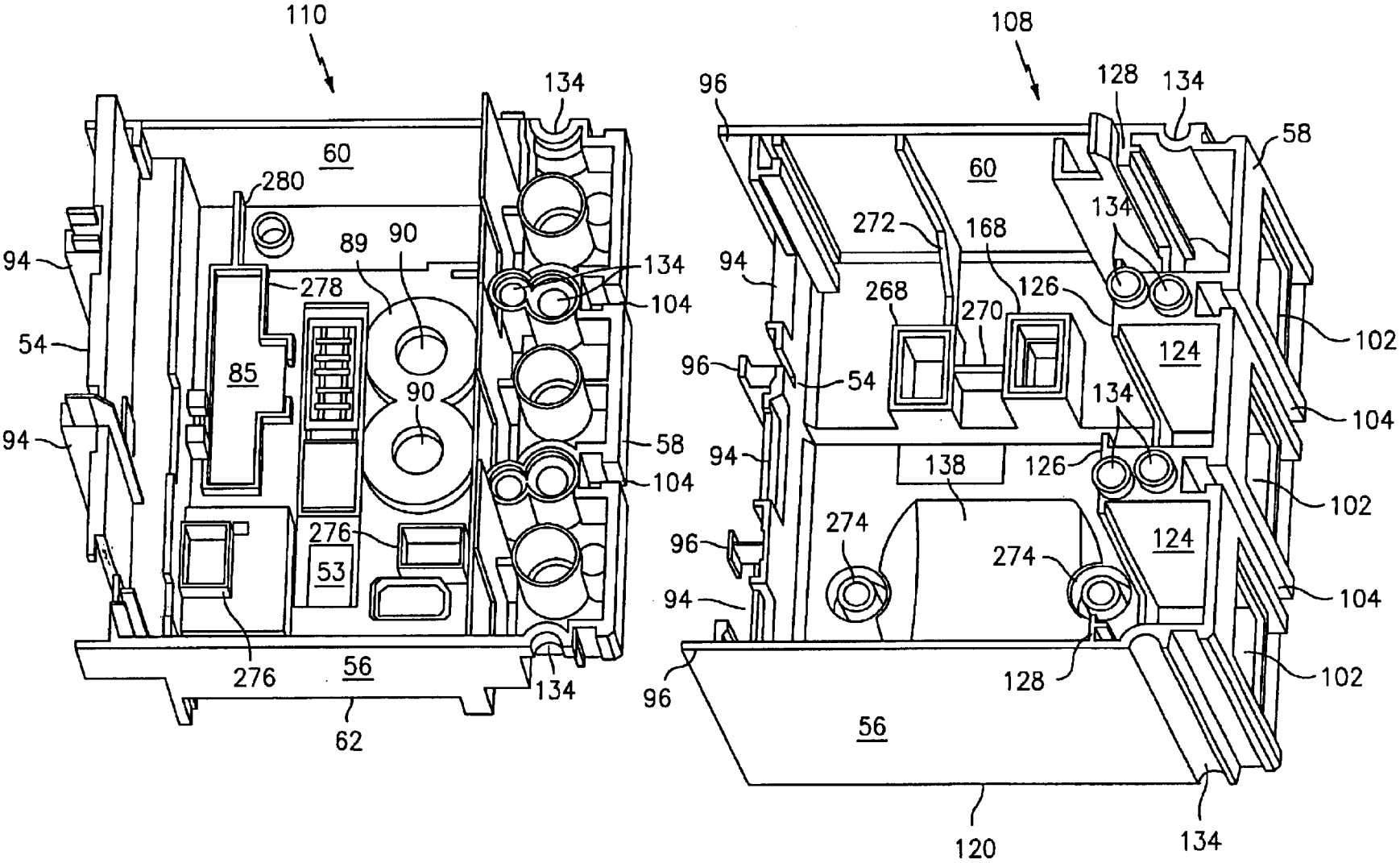
FIG. 6 is a perspective view showing the internal portions of the base and cover of the earth leakage detection device of FIG. 1.

Referring to FIGS. 4–6, the installation of trip/reset mechanism 116 into the internal portion of base 108 and cover 110 can be shown. FIG. 6 shows a perspective view of the top of base 108 and the bottom of cover 110. Reference will first be made to base 108. Extending upward from the internal surface of bottom 120 of base 108 are a plurality of walls forming two cavities 268 of rectangular cross section. Cavities 268 are sized to accept vibration dampers 258 fitted on support members 252 for resiliently securing trip/reset mechanism 116 to base 108. When installed, the body 262 of each vibration damper 258 extends within a cavity 268, with radiused protrusions 266 contacting walls of cavities 268. A wall 270 extends between the walls forming cavities 268 for providing rigidity to the walls. A buttress 272 extends from a wall forming one of the cavities 268 to the inner surface of the wall 60 for providing rigidity. A pair of cylindrical recesses 274 is formed in bottom 120. One cylindrical recess 274 is located on one side of a recess 138 formed in bottom 120, the other cylindrical recess 274 is located on the opposite side of recess 138. Cylindrical recesses 274 are sized to accept dowels extending from the bottom of electronic component and transformer mounting structure 118 for securing structure 118 to base.

Reference will now be made to cover 110. Extending downward from the internal surface of top 62 of cover 110 are a plurality of walls forming two cavities 276 of rectangular cross section. Cavities 276 are sized to accept vibration dampers 258 fitted on support members 252 for resiliently securing trip/reset mechanism 116 to cover 110. When installed, the body 262 of each vibration damper 258 extends within a cavity 276, with radiused protrusions 266 contacting the walls forming the cavities 276.

In the embodiment shown in FIGS. 4–6, both the electronic component and transformer mounting structure 118 and the trip/reset mechanism 116 are secured to both the cover 110 and the base 108. The increased stability of this arrangement, compared to having the internal structure and trip/reset mechanism mounted only to base, increases the immunity of these parts to damage due to shock. Also, trip/reset mechanism 116 is mounted independently from the electronic component and transformer mounting structure 118. By mounting the trip/reset mechanism 116 independently of structure 118, the trip/reset mechanism 116 is isolated from vibration induced in the current transformer. The use of vibration dampers to resiliently mount the trip/reset mechanism to the cover 110 and base 108 further insulates the trip/reset mechanism 116 from this vibration.

Figure 7:
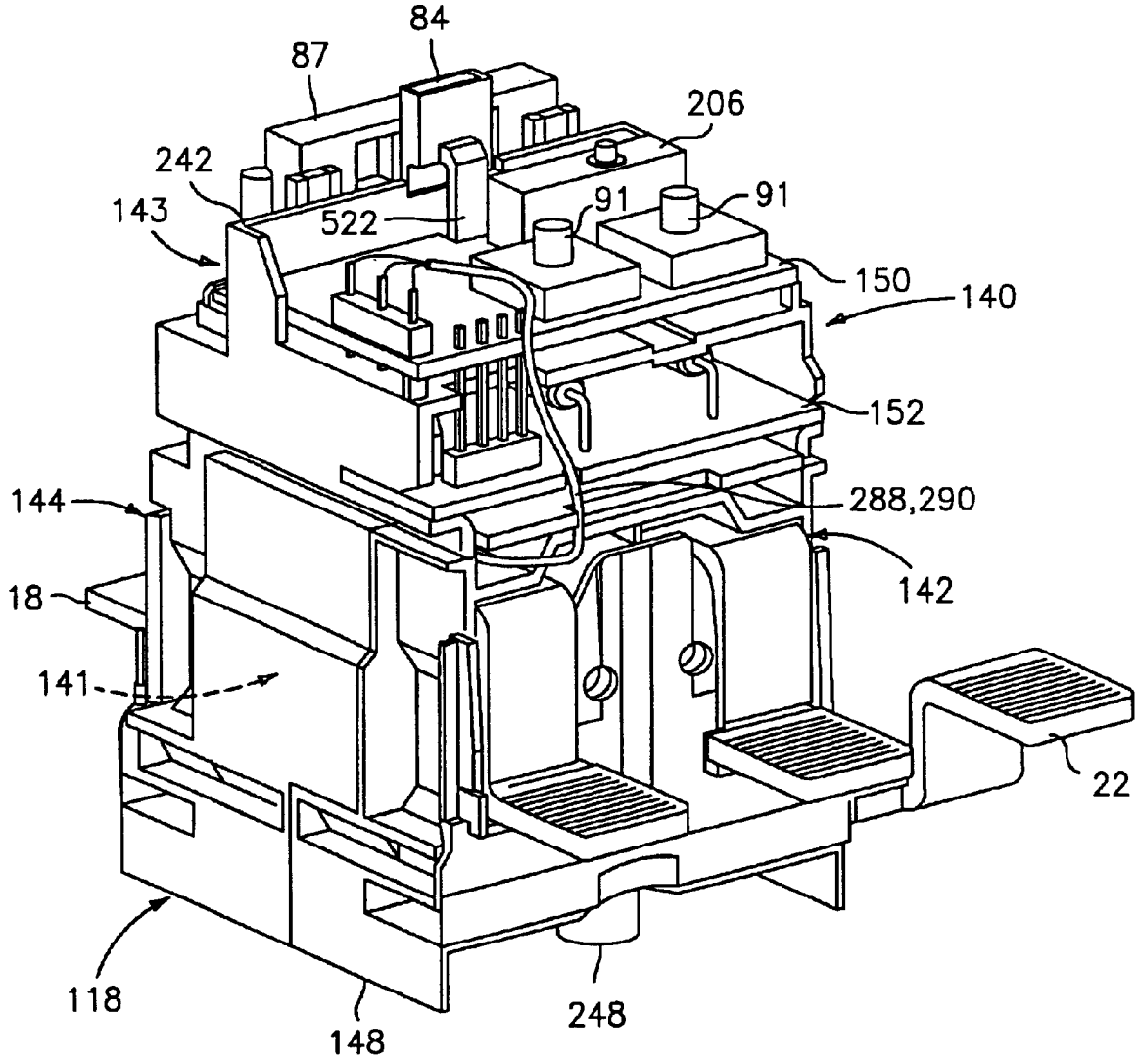
FIG. 7 is a perspective view of the electronic component and transformer mounting structure of the earth leakage detection device of FIG. 3.

Referring now to FIG. 7, a perspective view of the electronic component and transformer mounting structure 118 is shown. Structure 118 includes an electronics mounting portion 140 for mounting the earth leakage detection circuitry 114, which includes separate control and supply circuit boards 150 and 152. Structure 118 also includes a current transformer mounting portion 141, a line strap mounting portion 144, a load strap mounting portion 142, and a dielectric test cartridge mounting portion 143. A pair of dowels 248 extend from the bottom of structure 118 and are received by cylindrical recesses 274 in the base 108 (FIG. 6) to align structure 118 in base 108. Structure 118 is preferably molded of electrically insulative material.

Current transformer mounting portion 141 is formed in the lower portion of the electronic component and transformer mounting structure 118. The current transformer (not shown) is mounted behind a current transformer cover 148. The current transformer mounted therewithin provides a sample current used by earth leakage detection circuitry 114 to detect the existence of earth leakage, as is known in the art. The current transformer and current transformer mounting portion 141 will be discussed in further detail hereinafter.

Figure 8:
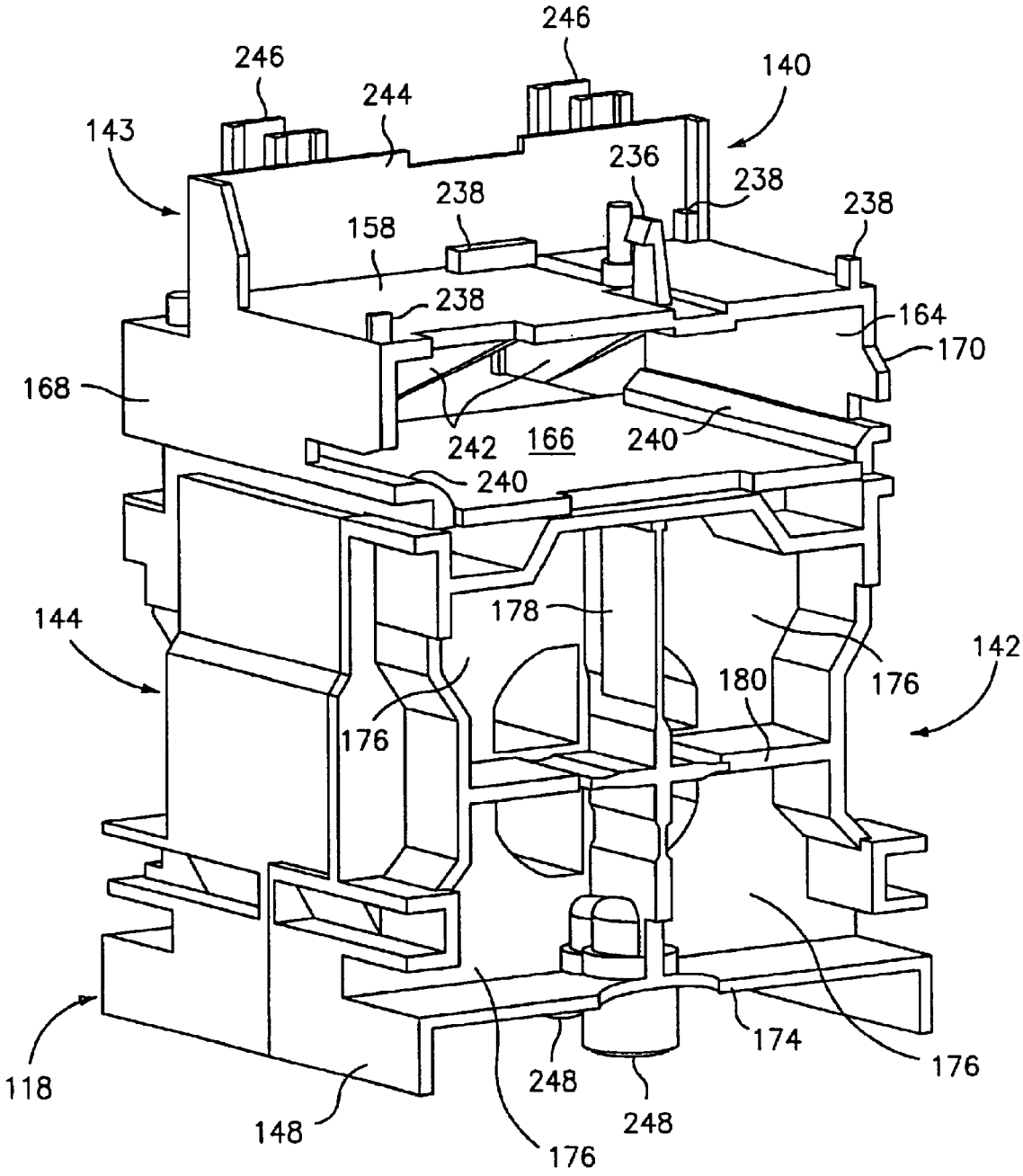
FIG. 8 is a perspective view of the electronic component and transformer mounting structure of FIG. 3 with electronic components removed.

Electronics mounting portion 140 is formed on the upper portion of the electronic component and transformer mounting structure 118. Electronics mounting portion 140 can be described by reference to FIGS. 7 and 8, where FIG. 8 shows the electronic component and transformer mounting structure 118 with earth leakage detection circuitry 114, line and load straps 18, 22, and dielectric test cartridge 87 removed. Electronics mounting portion 140 includes a substantially flat, rectangular surface formed on a top wall 158 of the electronic component and transformer mounting structure 118. A resiliently flexible leg 236 extends upwards from top wall 158. Leg 236 is fitted with a detent extending therefrom at a free end. Leg 236 extends through an aperture (not shown) formed in control circuit board 150 to snap-fit control circuit board 150 to the electronics mounting portion 140. When the control circuit board 150 is mounted onto electronics mounting portion 140, corners of the control circuit board 150 rest on protrusions 238, which keep circuit board 150 from contacting wall 158. A wall 244 extends from top wall 158, separating the control circuit board 150 from the dielectric test cartridge mounting portion 143. Electronics mounting portion 140 also includes an electronics mounting slot 164 formed beneath wall 158 for accepting supply circuit board 152. Slot 164 is of rectangular cross section, with wall 158 forming its top, a wall 166 forming its bottom, and walls 168 and 170 forming its sides. Slot 164 extends through the structure 118, from the line side of structure 118 to the load side of structure 118. Extending inwardly from side walls 168 and 170 are ledges 240, which extend the entire length of walls 168 and 170. Extending downwardly from the lower side of wall 158 are triangular fins 242. When the supply circuit board 152 is mounted within electronics mounting slot 164, ledges 240 provide support beneath the side edges of the supply circuit board 152 and fins 242 contact the top of the supply circuit board 152, sandwiching the supply circuit board 152 between ledges 240 and fins 242.

The load strap and line strap mounting portions 142, 144 also can also be described by reference to FIGS. 7 and 8. Load strap and line strap mounting portions 142, 144 are located beneath the electronics and dielectric test cartridge mounting portions 140 and 143, respectively. The load strap mounting portion 142 comprises a cavity formed between top wall 166, side walls 168 and 170, and a wall 174 that forms the bottom of the electronic component and transformer mounting structure 118. The cavity is divided into four equal quadrants 176 by a wall 178, which is substantially perpendicular to top and bottom walls 166 and 174, and a wall 180, which is substantially parallel to top and bottom walls 166 and 174. Within each quadrant 176, a load strap 22 is secured to a pass-through strap (not shown). Pass-through straps provide an electrical connection between each load strap 22 and its corresponding line strap 18, with each pass-through strap passing through the core of the current transformer (not shown) housed within structure 118, as will be described in further detail hereinafter. The line strap mounting portion 144 is similar to that shown for the load side. In the embodiment shown, three line straps 18 and three load straps 22 are used. However, load and line straps may be added or removed as needed for a particular distribution circuit.

The dielectric test cartridge mounting portion 143 can best be described by reference to FIGS. 9, 10, and 11. Dielectric test cartridge 87 forms the electrical connection between earth leakage detection circuitry 114 and the input line straps 18. Further detail of this connection can be seen in FIG. 10, where the electronic component and transformer mounting structure 118, and the outer casing of the dielectric test cartridge 87 are removed. As shown in FIG. 10, each input line strap 18 is electrically connected to a wire 600. Wires 600 are, in turn, electrically connected to clips 516, which are normally secured within the housing of the dielectric test connector cartridge 87. An electrical connection is made between clips 516 and pins 514, which extend from supply circuit board 152. When clips 516 are disposed on pins 514, electrical power is provided by the line straps 18 to the supply circuit board 152 via wires 600, clips 516 and pins 514. Supply circuit board 152 provides operating power to the control circuit board 150 via an electrical connection (not shown) between the two circuit boards 150, 152.

When the dielectric test cartridge 87 is moved upwards, pins 514 and clips 516 are separated (referred to hereinafter as the "contacts open" position), and the earth leakage detection circuitry 114 (i.e., the supply and control circuit boards 152, 150) is isolated from electrical current. When dielectric test cartridge 87 is pressed downwards, pins 514 are received by clips 516 and current flow to the earth leakage detection circuitry 114 is restored (referred to hereinafter as the "contacts closed" position). Thus, the dielectric test cartridge 87 acts as part of a dielectric test switch 115 between the input line straps 18 and the earth leakage detection circuitry 114, allowing the earth leakage detection circuitry 114 to be electrically isolated while dielectric tests are being performed.

Referring again to FIG. 9, the dielectric test cartridge 87 is supported at each corner by columns 500, which are secured to electronic component and transformer mounting structure 118. Dielectric test cartridge 87 extends into the electronics mounting slot 162 through a slot (not shown) disposed in the top of structure 118. Disposed on side edges of dielectric test cartridge 87, and extending between columns 500, are tabs 502. Each tab 502 includes a protrusion 504, which extends downwardly into a cylindrical void 506 formed in structure 118. Located within each cylindrical void 506 is a spring 519 that acts upon protrusion 504 to urge dielectric test cartridge 87 upward. A pair of resiliently flexible legs 512 extend upwardly from structure 118. Legs 512 have opposing detents formed thereon. A cylindrical protrusion 150 extends from a side of dielectric test cartridge 87. Cylindrical protrusion is captured between the pair of opposing detents to retain cartridge 87 in the contacts closed position against the force of springs 515.

Figure 9:
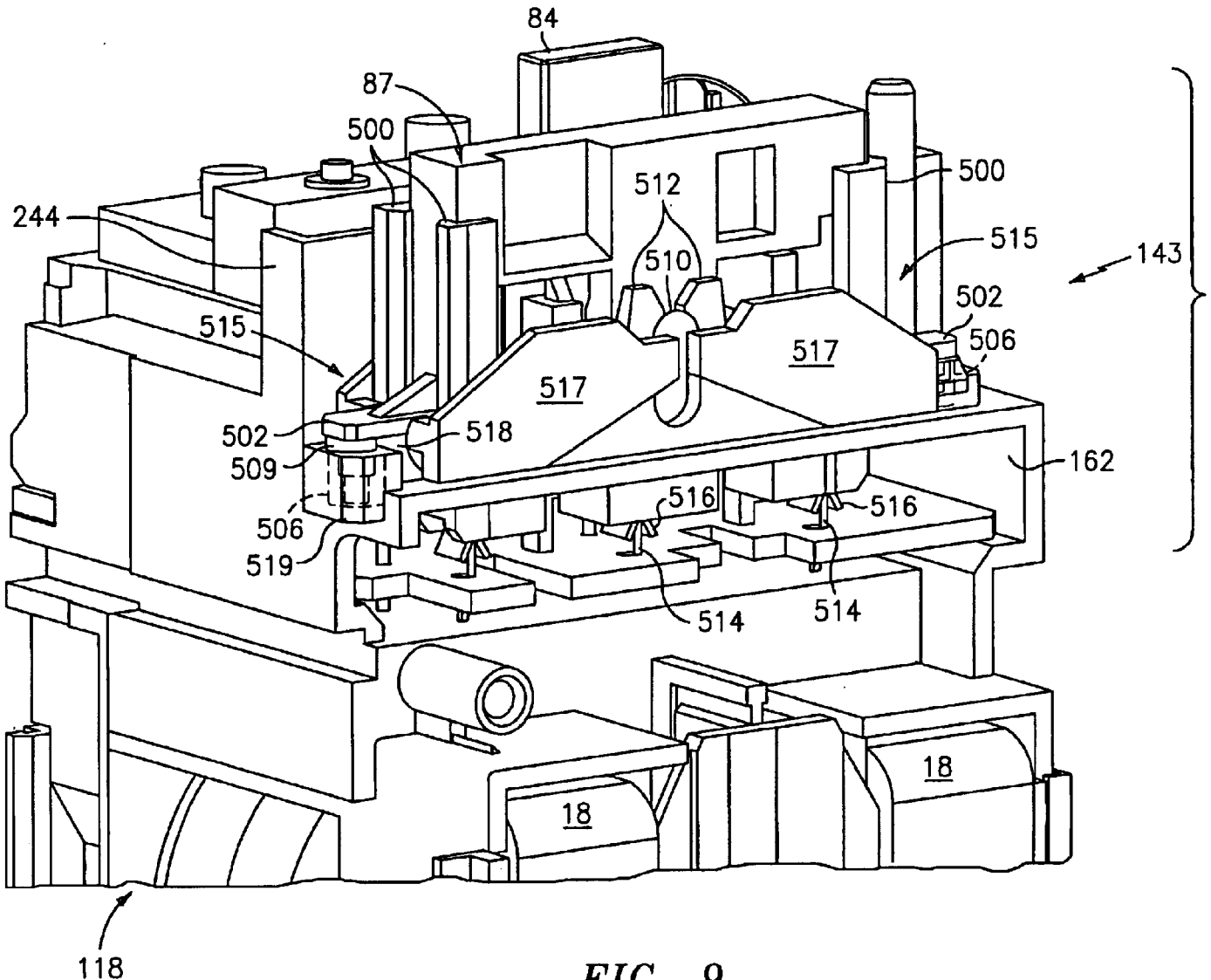
FIG. 9 is a perspective view of the dielectric test cartridge extractor of the electronic component and transformer mounting structure of FIG. 3.
Figure 10:
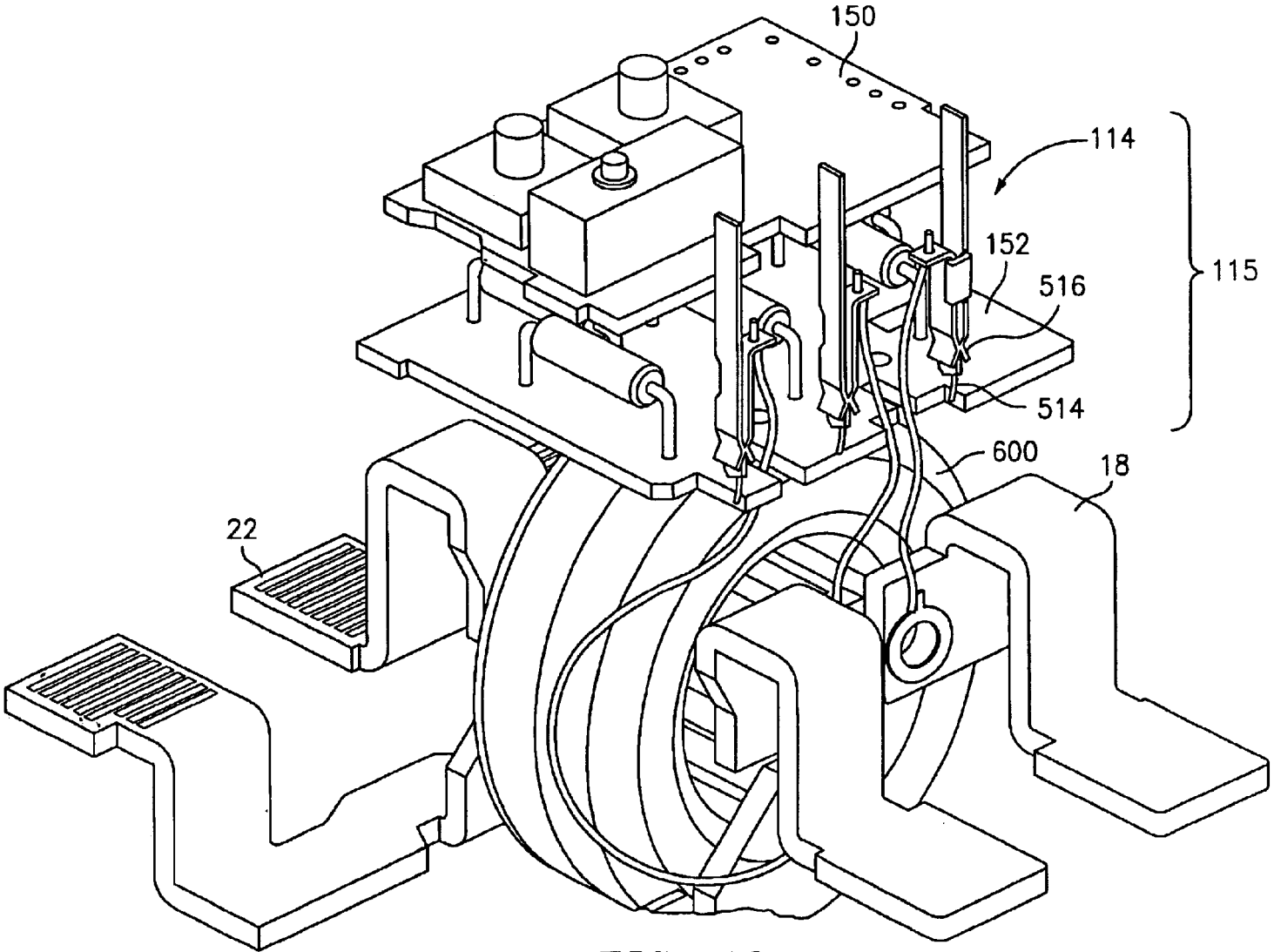
FIG. 10 is a perspective view of the internal configuration of the dielectric test cartridge of FIG. 9.
Figure 11:
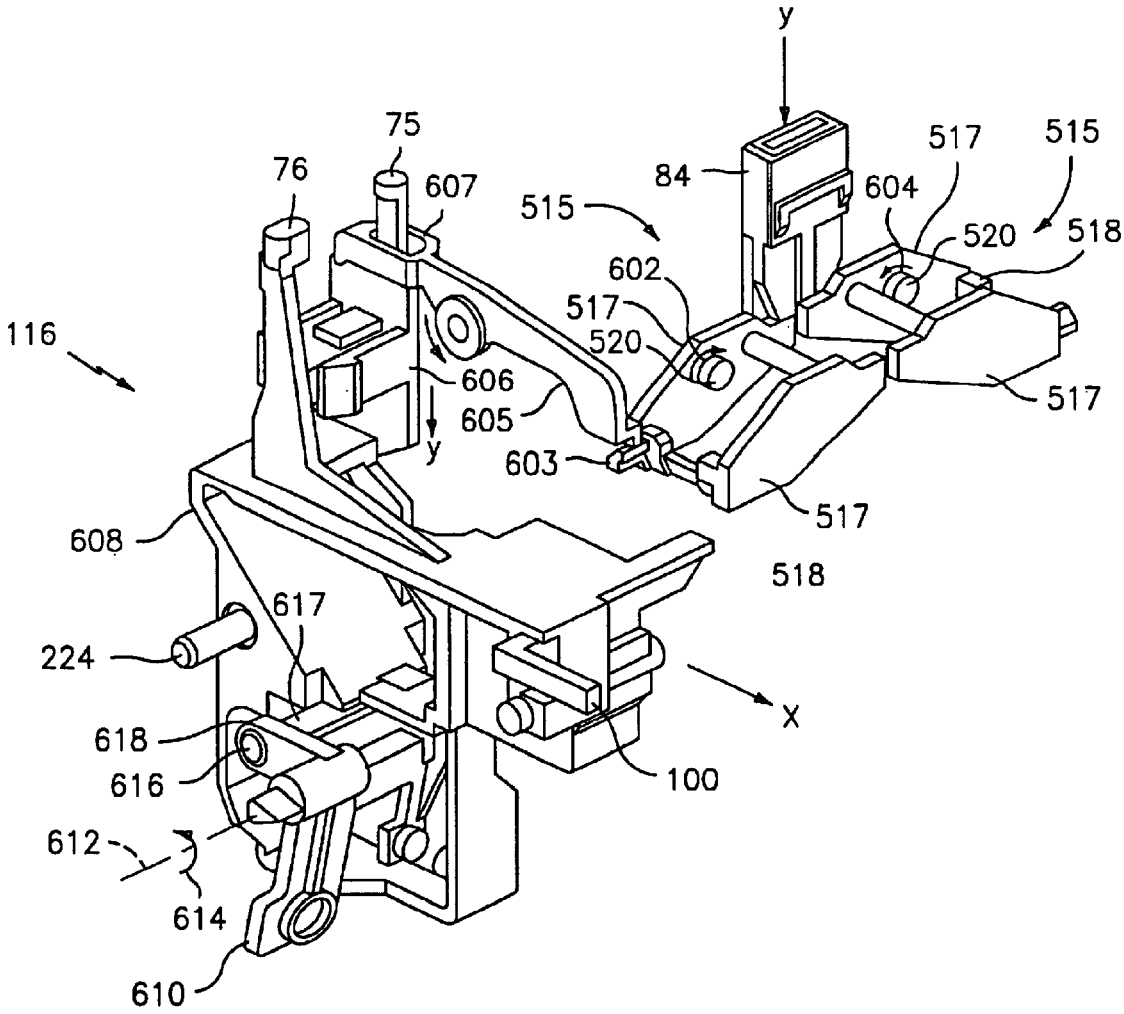
FIG. 11 is a perspective view of the linkage arrangement between the dielectric test cartridge extractor of FIG. 9 and the trip/reset mechanism of FIG. 4.

Referring to FIGS. 9 and 11, the cartridge extraction features of dielectric test switch 115 are shown. Disposed on sides of dielectric test cartridge 87 and beneath tabs 502 are a pair of cartridge extraction levers 515. Each cartridge extraction lever 515 includes two side arms 517, which extend from a common pin 518 disposed beneath tabs 502. Each arm 517 of cartridge extraction levers 515 includes a cylindrical protrusion 520 formed thereon at a location between the pin 518 and a free end of the arm 517. Cylindrical protrusions 520 are pivotally secured to the electronic component and transformer mounting structure 118. A bottom end of dielectric test connector push button 84 is arranged proximate to the free ends of the arms 517 on one side of the dielectric test cartridge 87.

Pressing the dielectric test connector push button 84 in the direction "y" causes arms 515 to pivot about the longitudinal axis of cylindrical protrusions 520 in the directions of arrows 602 and 604, causing the pins 518 to move upward. If the force applied to the push button 84 is sufficient to overcome the retaining force of the resiliently flexible legs 512, cylindrical protrusion 510 will be released from the resiliently flexible legs 512 and dielectric test cartridge 87 will move upward under the urgence of the pins 518 and the springs 515. The upward movement of the dielectric test cartridge 87 will separate the electrical connection between pins 514 and clips 516. The force of springs 515 will hold the dielectric test cartridge 87 in the contacts open position. To return the dielectric test cartridge 87 to the contacts closed position, a technician will push downward on the cartridge 87 until the cylindrical protrusion 510 is again captured by the detents of the resiliently flexible legs 512.

Referring to FIGS. 2 and 9, it will be recognized that tabs 502, extend wider than aperture 85, preventing cartridge 87 from being removed from the earth leakage detection device 14 unless cover 110 is first removed. This design ensures that the dielectric test cartridge will not be lost when dielectric testing is being performed.

Referring again to FIG. 11, the interconnection between the dielectric test switch 115 and the trip/reset mechanism 116 is shown. The pin 518 of one of the dielectric test cartridge extraction levers 515 includes a tab 603 extending therefrom. Tab 603 is positioned below a first end of a lever arm 605 that is pivotally mounted to an external portion of the housing (not shown) of trip/reset mechanism 116. A second end of lever arm 605 has a yoke 607 formed thereon. Yoke 607 is disposed about the mechanical trip test button 75, which extends from trip/reset mechanism 116.

In FIG. 11, the housing of the trip/reset mechanism 116 has been removed to reveal the pertinent internal portions of the trip/reset mechanism 116. These internal portions of trip/reset mechanism 116 include a mechanical trip test rod 606, a main carrier 608, and a latch lever 610. Mechanical trip test button 75 is disposed on a free end of mechanical trip test rod 606. The opposite end of mechanical trip test rod 606 is operatively connected to latch lever 610, such that moving mechanical trip test rod 606 in the "y" direction causes latch lever 610 to pivot about an axis 612 in the direction indicated by arrow 614. Latch lever 610 is secured to the housing of the trip/reset mechanism 116 such that it is free to rotate about the axis 612.

Extending from the top of main carrier 608 is the trip indicator 76. Extending from sides of main carrier 608 are auxiliary switch driver 224 and actuation plunger 100. Main carrier 608 is biased to move in the "x" direction by a spring (not shown). However, main carrier 608 is prevented from moving in the "x" direction by a pin 616 disposed on an end of the latch lever 610. Disposed around pin 616 is a roller that rests against a shoulder 618 formed on the main carrier 608 to hold the main carrier 608 in a latched position.

It can be seen that pressing the dielectric test connector push button 84 to remove the dielectric test cartridge 87 (FIG. 9) causes the tab 603 to move upwards. As tab 603 moves upwards, lever arm 605 pivots causing yoke 607 to move the a mechanical trip test rod 606 in the "y" direction. Movement of the mechanical trip test rod 606 in the "y" direction causes the latch lever 610 to rotate about axis 612 in the direction indicated by arrow 614. As the latch lever 610 rotates, pin 616 and roller 617 are released from shoulder 618, allowing main carrier 608 to move in the "x" direction under the urgence of the spring. It will be recognized that roller 617 reduces the friction between the latch lever 610 and the shoulder 618 of the main carrier 618. After the main carrier 608 has been unlatched, trip indicator 76, auxiliary switch driver 224, and actuation plunger 100 move with main carrier 608. As described hereinabove, movement of trip indicator 76 provides visual indication that the trip/reset mechanism 116 has been tripped (FIG. 2); movement of the actuation plunger 100 causes the actuation plunger 100 to actuate the operating mechanism of the circuit breaker 12, thereby causing the circuit breaker 12 to trip (FIGS. 1 and 2); and movement of the auxiliary switch driver 224 activates the auxiliary switch 112 (FIG. 4). The interconnection between the dielectric test switch 115 and the trip/reset mechanism 116 ensures that the circuit breaker 12 can not be closed to allow electrical current to flow to the protected circuit until the dielectric test cartridge 87 is returned to its contacts closed position.

Figure 12:
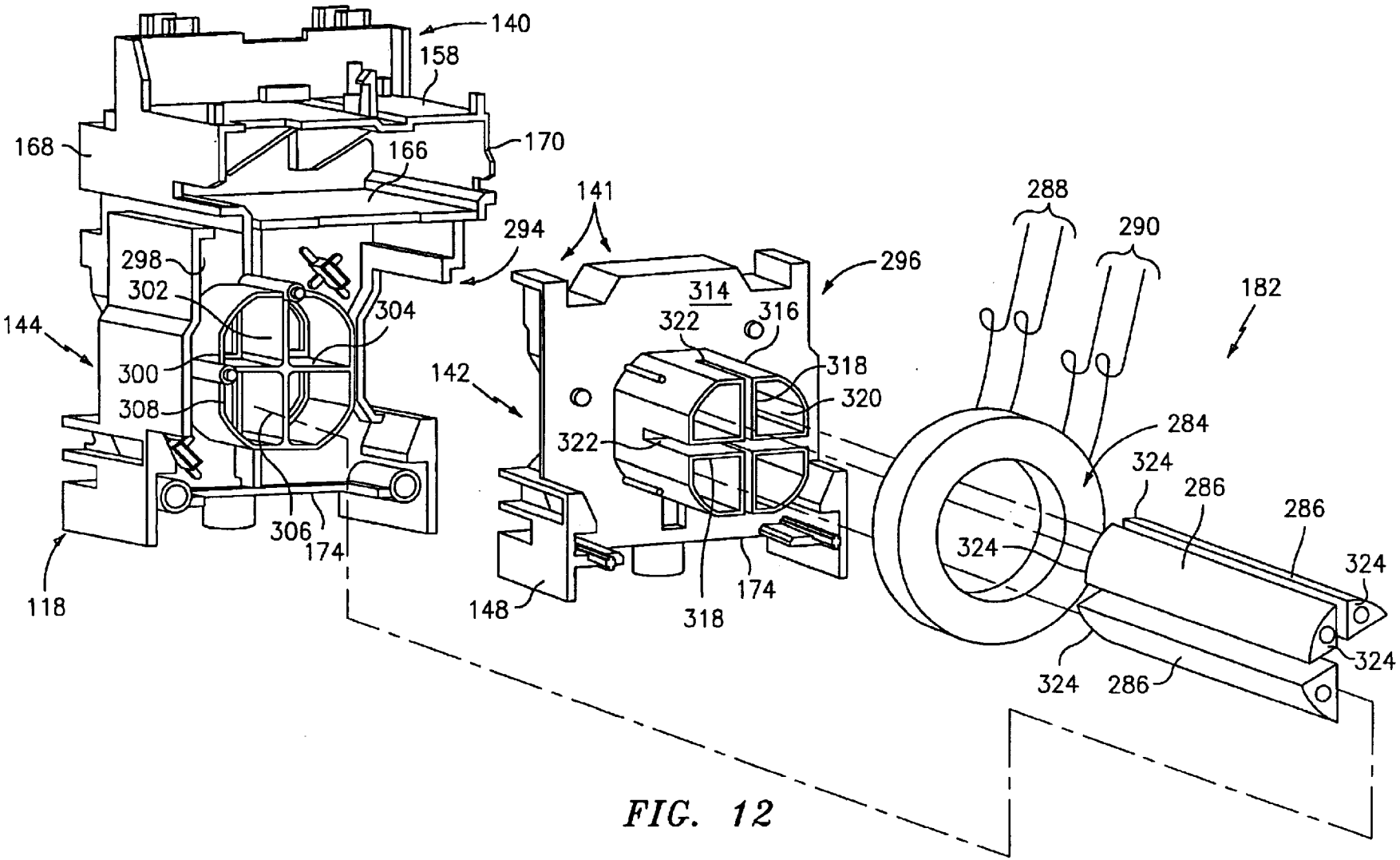
FIG. 12 is a perspective exploded view of the electronic component and transformer mounting structure of FIG. 8.

Current transformer mounting portion 141 will now be shown by reference to FIG. 12, where the electronic component and transformer mounting structure 118 is shown with transformer cover 148 removed to reveal current transformer 182. Current transformer 182 includes a toroidal assembly 284 disposed about pass-through straps 286. Toroidal assembly 284 includes two pairs of wires 288 and 290 extending therefrom for attaching to the control circuit board 150 (see FIG. 7). Wires 288 and 290 are disposed about a ferrous core within toroidal assembly 284, and form secondary windings in current transformer 182. Toroidal assembly 284 and pass-through straps 286 are supported by transformer mounting portion 141. Transformer mounting portion 141 includes line side and load side supports 294 and 296, which extend from the electronic component and transformer mounting structure 118 and the transformer cover 148, respectively. Electronic component and transformer mounting structure 118 includes a transformer shield wall 298 extending between top wall 166 and bottom 174, and from side wall 168 to side wall 170. Line side support 294 extends from a central region of shield wall 298. Line side support 294 is formed substantially into a hollow circular cylinder 300 having a longitudinal axis perpendicular to shield wall 298. Line side support 294 further comprises walls 302 and 304, which bisect the longitudinal axis of cylinder 300 to divide the cylinder into four equal quadrants 306 corresponding to quadrants (not shown) in the line strap mounting portion 144 on the opposite side of shield wall 298. Quadrants 306 communicate with their corresponding quadrants via holes 308 in shield wall 298.

Transformer cover 148 includes a transformer shield wall 314 with the load side support 296 extending from a central region of transformer shield wall 314. Load side support 296 is formed substantially into a hollow circular cylinder 316, with its longitudinal axis perpendicular to shield wall 314. Walls 318 divide the cylinder into four equal quadrants 320 corresponding to quadrants 176 in the load strap mounting portion 172 formed on the opposite side of shield wall 314. Quadrants 320 communicate with their corresponding quadrants 176 via holes in shield wall 314. Slots 322 are formed between walls 318 for slidably accepting walls 302 and 304 of line side support 294. The inside diameter of cylinder 300 is greater than the outside diameter of cylinder 316, thus allowing quadrants 306 on the line side to slidably accept quadrants 320 on the load side in registered relationship.

Pass-through straps 286 are each shaped as one quarter of a longitudinally-quartered cylinder. The size and shape of pass-through straps 286 approximates the size and shape of quadrants 320, allowing one pass-through strap 286 to fit within each quadrant 320. Ends of pass-through straps 286 include holes 324 for accepting screws (not shown), bolts, or similar means to secure line and load straps 18 and 22 to pass-through straps 286. Holes 324 may extend through the length of pass-through straps 286 to accept a long bolt for tying line and load straps 18 and 22 to pass-through straps 286. Pass-through straps 286 are constructed of electrically conductive material for passing current from line straps 18 to load straps 22.

Current transformer mounting portion 141 is assembled by first placing toroidal assembly 284 over load side support 296, and placing pass-through straps 286 within quadrants 320. The transformer cover 148 is then assembled onto the electronic component and transformer mounting structure 118 by slidably engaging quadrants 320 within quadrants 306. When assembled, the walls forming quadrants 306 and 320 extend over pass-through straps 286, electrically insulating pass-through straps 286 from toroidal assembly 284.

Figure 13:
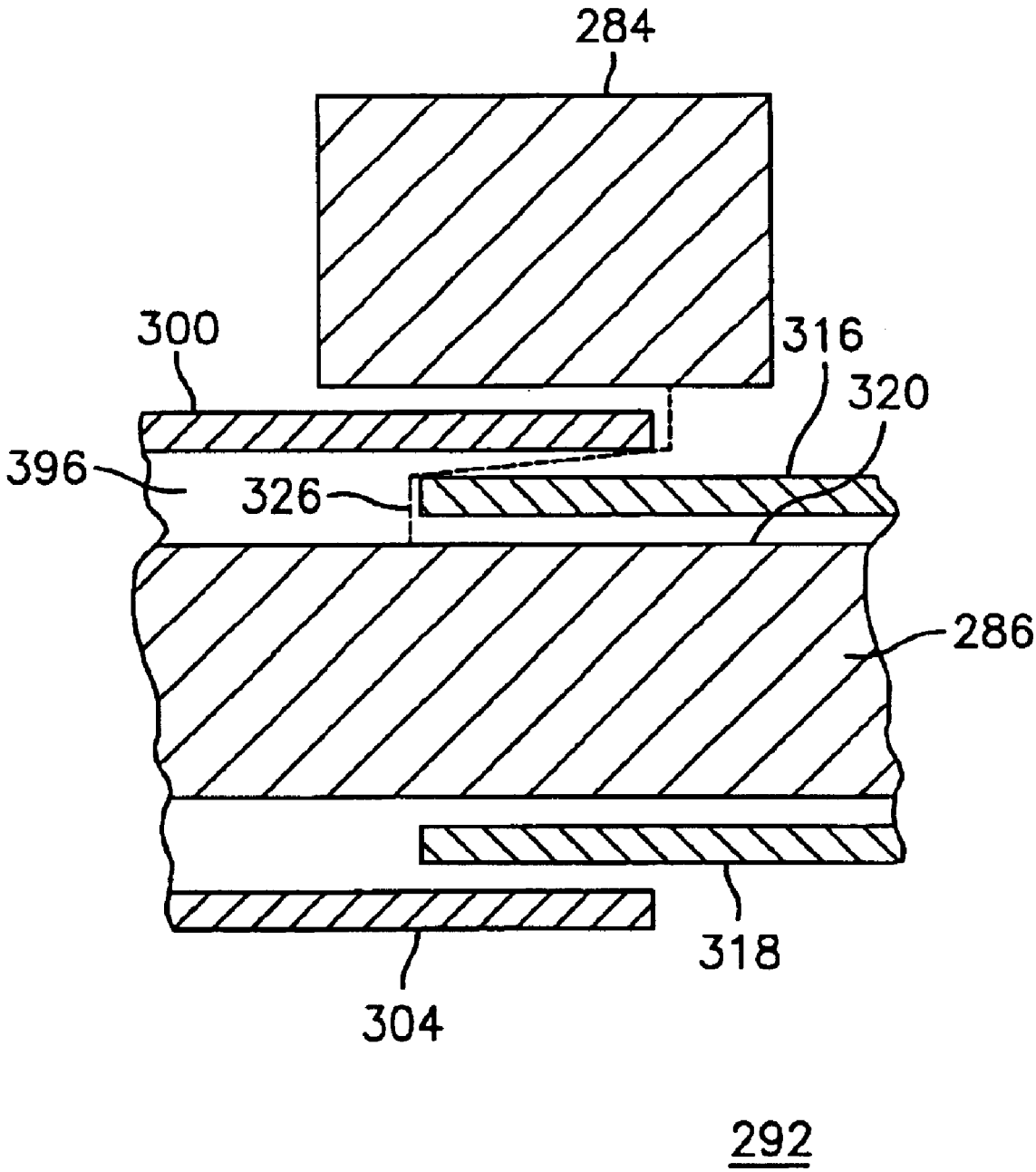
FIG. 13 is a sectional view of the current transformer of FIG. 12.

FIG. 13 shows a sectional view of an assembled current transformer mounting portion 141. Pass through strap 286 extends within quadrants 306 and 320, with overlapping walls 300 and 316, 304 and 318 electrically insulating pass-through strap 286 from toroidal assembly 284. The overlap of walls 300 and 316, and 304 and 318 forms an electrical creepage path identified by line 326. The length of this electrical creepage path 326 (i.e. the creepage distance) is dictated by the amount that walls 300 and 316, and 304 and 318 overlap. The amount of overlap can be designed to meet the minimum creepage distance required to allow the earth leakage detection device 14 to withstand minimum required insulation voltage. The use of walls 300 and 316, and 304 and 318 to support pass-through straps 286 and to form the insulation around the pass-through straps 286 eliminates the need to wrap each pass-through strap 286 with tape or other insulative material. By eliminating the need to insulate each strap individually, the present embodiment allows a time consuming manufacturing step (i.e. wrapping the pass-through straps with tape) to be eliminated.

The embodiment shown in FIG. 12 uses two secondary windings 288 and 290 in the current transformer. Winding 288 (the "sensing" winding) provides a sample current for use by the detection circuitry in detecting the existence of earth leakage. Winding 290 (the "test" winding) is used to test the winding 288 and earth leakage detection capability of earth leakage detection circuitry 114.

Referring to FIGS. 1, 3 and 12, the earth leakage detection test is performed by depressing the trip button 86, which causes the earth leakage detection circuitry 114 to inject a differential test current to the test winding 290. The sensing winding 288 will detect this signal as a differential fault current, which will cause the earth leakage detection circuitry 114 to activate trip/reset mechanism 116. Activation of trip/reset mechanism will cause plunger 100 to interact with the trip mechanism (not shown) of circuit breaker 12, causing circuit breaker 12 to trip.

The use of test winding 290 makes it possible to perform a "true" earth leakage detection test. That is, the current transformer, the earth leakage detection circuitry, and the connection therebetween are all tested.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An earth leakage detection device for detective earth leakage in an electrical distribution circuit and for actuating a circuit breaker when earth leakage is detected, the earth leakage detection device comprising:

a housing;

an earth leakage detection circuit mounted within said housing for detecting earth leakage in the electrical distribution circuit;

an electrically conductive strap arranged to conduct electrical current to the electrical distribution circuit, said electrically conductive strap for providing operating current to the earth leakage detection circuit; and a dielectric test switch arranged between said electrically conductive strap and said earth leakage detection circuit, said dielectric test switch including a button disposed in said housing, wherein manipulating said button causes said dielectric test switch to stop the flow of electrical current from said electrically conductive strap to said earth leakage detection circuit during dielectric testing;

wherein said dielectric test switch includes:

a dielectric test cartridge arranged within said housing, said dielectric test cartridge having a clip disposed therein, said clip being in electrical connection with said electrically conductive strap and arranged to receive a pin extending from said earth leakage detection circuit; and wherein manipulating said button moves said dielectric test cartridge to separate said clip from said pin to stop the flow of electrical current from said electrically conductive strap to said earth leakage detection circuit during dielectric testing.

2. The earth leakage detection device of claim 1, wherein said dielectric test switch further includes:

a spring arranged to force said clips away from said pins during dielectric testing.

3. The earth leakage detection device of claim 1, wherein said dielectric test switch further includes:

a dielectric test cartridge extraction lever pivotally secured within said housing, said dielectric test cartridge extraction lever having a first end arranged proximate said button and a second end arranged beneath a tab extending from said dielectric test cartridge for moving said dielectric test cartridge.

4. The earth leakage detection device of claim 1, wherein said dielectric test switch further includes:

a pair of resiliently flexible legs secured within said housing, each of said resiliently flexible legs having a detent formed on a free end; and a protrusion extending from said dielectric test cartridge, said protrusion being received between said resiliently flexible legs for holding said dielectric test cartridge in place.

5. The earth leakage detection device of claim 1, further comprising:

a trip/reset mechanism mounted within said housing, said trip/reset mechanism being configured to actuate the circuit breaker when said button is manipulated.

6. The earth leakage detection device of claim 3, further comprising:

a trip/reset mechanism mounted within said housing, said trip/reset mechanism being configured to actuate the circuit breaker when said button is manipulated.

7. The earth leakage detection device of claim 6, wherein said dielectric test switch further includes:

a lever arm pivotally secured within said housing, said lever arm including a first end disposed proximate said second end of said dielectric test cartridge extraction lever, said lever arm further including a second end arranged proximate said trip/reset mechanism, wherein said lever arm causes said trip/reset mechanism to actuate the circuit breaker when said button is manipulated.

8. An earth leakage detection device for detecting earth leakage in an electrical distribution circuit and for actuating a circuit breaker when earth leakage is detected, the earth leakage detection device comprising:

a housing;

an earth leakage detection circuit;

an electrically conductive strap arranged to conduct electrical current to the electrical distribution circuit, said electrically conductive strap for providing operating current to the earth leakage detection circuit; and a dielectric test switch arranged in signal communication with said electrically conductive strap and said earth leakage detection circuit, said dielectric test switch including an actuator disposed at said housing, wherein manipulating said actuator causes said dielectric test switch to interfere with the flow of electrical current from said electrically conductive strap to said earth leakage detection circuit;

wherein said dielectric test switch further includes:

a dielectric test cartridge arranged within said housing, said dielectric test cartridge having a first conductive portion, said first conductive portion being in electrical communication with said electrically conductive strap and arranged to electrically communicate with a second conductive portion disposed at said earth leakage detection circuit; and wherein manipulating said actuator moves said dielectric test cartridge in a direction to separate said first conductive portion from said second conductive portion to interfer with the flow of electrical current from said electrically conductive strap to said earth leakage detection circuit during dielectric testing, thereby resulting in the registration of an earth leakage.

* * * * *